United States Patent [19]

Marizy

[11] 4,324,584

[45] Apr. 13, 1982

[54] PROCESS FOR THE DECARBURIZATION OF CHROMIUM-CONTAINING PIG IRON

[75] Inventor: Georges Marizy, Ugine, France

[73] Assignee: Ugine Aciers, Paris, France

[21] Appl. No.: 221,903

[22] Filed: Dec. 31, 1980

[30] Foreign Application Priority Data

Jan. 24, 1980 [FR] France ..... 80 01809

[51] Int. Cl.[3] ..... C21C 7/00

[52] U.S. Cl. ..... 75/60; 75/59; 75/130.5

[58] Field of Search ..... 75/60, 59, 130.5

[56] References Cited

U.S. PATENT DOCUMENTS

| | | | |
|---|---|---|---|
| 3,575,696 | 4/1971 | Rehmus | 75/60 |
| 3,793,002 | 1/1974 | Borgnat | 75/60 |
| 3,861,905 | 1/1975 | Steinmetz | 75/60 |
| 3,992,194 | 11/1976 | Leroy | 75/60 |

FOREIGN PATENT DOCUMENTS

| | | | |
|---|---|---|---|
| 2018283 | 12/1970 | Fed. Rep. of Germany | 75/60 |
| 2651922 | 5/1978 | Fed. Rep. of Germany | 75/60 |
| 1407182 | 6/1965 | France | 75/60 |

*Primary Examiner*—P. D. Rosenberg

*Attorney, Agent, or Firm*—Dennison, Meserole, Pollack & Scheiner

[57] ABSTRACT

A process is disclosed for the decarburization of a molten bath of chromium-containing pig iron which, in a single operation, permits decarburization by means of an oxygen jet and thus permits chromium or nickel chromium steels to be obtained directly, the decarburization of which can readily be completed by a final treatment under vacuum carried out immediately after the injection of oxygen. The process comprises adjusting the temperature conditions of the pig iron bath and regulating the oxygen jet distance from the surface of the bath and speed of oxygen gas so that the impact force of the oxygen creates a gas-metal emulsion within which the carbon contained in the pig iron is oxidized directly by the oxygen. The carbon content is thus rapidly reduced to less than 0.3% whereas the yield of chromium is higher than 97%. The process is suitable for the preparation of all grades of Cr and NiCr stainless steel, which optionally contain additions of Co, Mn or Mo.

5 Claims, No Drawings

PROCESS FOR THE DECARBURIZATION OF CHROMIUM-CONTAINING PIG IRON

BACKGROUND OF THE INVENTION

1. Field of the Invention

The process forming the subject of the invention relates to the decarburization of chromium-containing or nickel chromium-containing pig iron containing by weight from about 1.5 to 8% of carbon, from 10 to 30% of Cr, up to 30% of Ni, and optionally Co, Mn and Mo.

2. Description of the Prior Art

Numerous processes are known for carrying out the decarburization of pig iron by the action of oxygen alone or mixed with other gases at atmospheric pressure or under a reduced pressure. The oxygen or the gaseous mixture can be placed in contact with the liquid metal, for example by injection through the bottom of a converter or, on the other hand, can be brought to the surface above the level of the metal.

In particular, in the Linz-Donawitz (LD) process, the pig iron to be decarburized is treated in a vertical converter by means of a lance pipe arranged above the level of the liquid pig iron. This lance pipe delivers a jet of oxygen which strikes the surface of the liquid metal bath.

Recent research into this process permits better understanding of the action of the jet of oxygen on the metal bath and the slag covering it.

Thus, the article of J. Schoop, W. Resch and G. Mahn entitled "Reactions Occuring During the Oxygen Top Blown Process and Calculation of Metallurgical Control Parameters", Ironmaking and Steelmaking, 1978, Vol. 5, No. 2, pages 72–79, describes the mechanism involved in the dephosphorization and the decarburization of pig iron by the LD process applied to a 200 T converter. This article shows that, in this process, the reactions between the oxygen and the liquid metal take place mainly due to the presence of droplets of liquid metal in the slag. The flow-rate of liquid metal sprayed in droplets through the slag depends on the force of impact of the jet of oxygen on the liquid metal. This flow-rate of metal can attain and even exceed one ton per second. Under these conditions, the contact surfaces between the liquid metal and the slag are multiplied by 100. A true emulsion is formed between the liquid metal, the slag and the gaseous mixture, the volume of which depends not only on the impact force of the oxygen jet but also on the characteristics of fluidity of the slag. According to this article, the phosphorus is removed preferentially in the case of low impact forces, whereas the carbon is removed preferentially in the case of high impact forces.

Analysis of the results has shown that, under conditions which are favorable to dephosphorization, the P content of the droplets is 100 times smaller than that of the metal bath. An increase in the impact force of the oxygen jet on the metal bath promotes the decarburization reaction as it causes an increase in the flow rate of sprayed droplets which can thus exceed one ton per second, as mentioned above. The very rapid decarburization now taking place is assisted by the fact that the metal droplets burst due to the formation of CO bubbles.

The article by A. Chatterjee, N. O. Lindfors and J. A. Wester entitled "Process Metallurgy of LD Steelmaking" Ironmaking and Steelmaking, 1976, Vol. 3, No. 1, describes, more particularly the procedure for decarburizing pig iron by the LD process. It shows clearly that the oxygen jet, which is supersonic at the tuyere outlet, produces by its impact an emulsion between the liquid metal, the slag and a very significant gaseous phase containing the oxygen and the carbon oxides in variable proportions. The volume of the emulsion depends largely on the viscosity of the slag. The very fluid slags rich in FeO result in the formation of emulsions with volumes which are, at the end of the oxygen blast, from three to four times that of the liquid metal. The decarburization of the droplets of liquid metal within the emulsion is caused by two concurrent processes: the oxidation of the carbon by the oxygen contained in the gaseous phase and the oxidation of the carbon by the FeO contained in the slag.

This prior art process, developed initially for the decarburization of ordinary pig iron, has been adapted for the treatment of chromium pig iron, for example in the manner described in the article by Carlson and Shaw entitled "Stainless Steel by BOF Process", Iron and Steel Engineer, August, 1972, pages 53–58. This article shows that a synthetic Cr pig iron obtained by mixing ordinary pig steel and carburized ferrochromium containing approximately 4% of carbon and approximately 15 to 16% of chromium is decarburized by insufflation of oxygen to a final C content of 0.05%. At the end of decarburization, the temperature exceeds 1,900° C. In this process, mainly at the beginning of blasting of oxygen, significant quantities of Cr and Fe oxides are formed by the action of the oxygen on the pig iron and pass into the slag. Once the concentration of these oxides in the slag is sufficiently high, they react with the carbon contained in the metal bath and the CO formed in liberated. A proportion of the chromium oxide formed at the beginning of the reaction is entrained by the hot gases in the form of dust. Another proportion remains in the slag and can be reduced and recovered during a subsequent reduction operation by silicothermia.

This is therefore a process comprising several stages which demands relatively expensive retreatment of the slag in order to recover a proportion of the chromium and, moreover, it is difficult to recover the chromium oxide entrained in the hot gases. In addition, the necessary presence in this process of a slag rich in chromium oxide for effecting decarburization does not afford only advantages. In fact, there are also disadvantages since this slag reduces the effectiveness of the impact of the oxygen jet on the metal bath and therefore slows down the stirring thereof. Decarburization is therefore decelerated and, on the other hand, the losses of Cr due to oxidation increase.

SUMMARY OF THE INVENTION

Research has been carried out into the possibility of accelerating the decarburization of chromium pig iron by effecting the direct decarburization of the pig iron using oxygen and by avoiding, as far as possible, for decarburization, contact between the pig iron and a slag rich in $Cr_2O_3$ which leads to losses of $Cr_2O_3$ either in the actual slag or by entrainment in the fumes.

The process according to the present invention is suitable for decarburization of chromium pig iron containing by weight: from about 1.5 to about 8% C, from about 10 to about 30% Cr, from about 0 to about 30% Ni, from about 0 to about 20% Co+Mn+Mo, and less than about 4% Si, as well as the normal impurities, balance Fe. The process involves carrying out decarburization using a means e.g. a lance, for forming an oxygen jet having a zone wherein the speed of the oxygen gas is effectively supersonic, which supersonic zone is directed towards, i.e., onto, the surface of the liquid pig iron and which, at least during the final phase of decarburization, causes the formation of a gas-pig iron emulsion within which the carbon is oxidized directly by the oxygen, this final phase beginning once the carbon content of the chromium pig iron is equal to $C_D/n$, n being between about 1.5 and about 2.5, and $C_D$ being the initial carbon content in weight percent of the pig iron.

DESCRIPTION OF THE PREFERRED EMBODIMENTS

More specifically, a liquid pig iron bath containing by weight, from about 1.5 to about 8% C, from about 10 to about 30% Cr, from about 0 to about 30% Ni, from about 0 to about 20% Co+Mn+Mo and less than about 4% of Si, and the normal impurities, is introduced into a vertical converter of a type comparable to those used for decarburization by the LD process.

This converter contains a basic lining which is resistant to very high temperatures. In particular, chromium magnesia-type bricks can be used.

The metal is covered with a limited quantity of a lime-based slag.

Decarburization is effected by injecting oxygen at high pressure using a lance pipe which penetrates the top of the converter. This lance pipe comprises a so-called supersonic tuyere which emits, in the direction of the surface of the metal bath, an oxygen jet comprising a small zone in which the speed of this gas is effectively supersonic.

This supersonic zone extends along the axis of the jet a length which depends on the oxygen pressure and the diameter of the tuyere at the neck, that is to say at the point where its diameter is smallest. The jet is orientated approximately vertically and the distance between the end of the tuyere and the initial surface of the metal bath is adjusted to a value approximately equal to that corresponding to the end of the supersonic zone of the oxygen jet. In practice, the distance between the lance pipe and initial surface of the bath varies between five and thirty times the diameter of the tuyere neck. Moreover, the specific rate of flow of oxygen per ton of liquid pig iron should be approximately 3 $Nm^3$/mn at a pressure varying between 8 and 12 relative bars.

Under these conditions, a first reaction phase is observed, during which the layer of slag is gradually expelled from the surface of the bath by the gaseous jet, at the same time a rapid oxidation of the most oxidizable elements contained in the pig iron takes place. It is mainly the chromium which is oxidized in this period. At the same time, the temperature of the metal rises rapidly. In a second phase, the chromium oxidized at the start is reduced by the carbon, of which there is still a high content in the metal bath. The temperature continues to rise during this period of reduction of the chromium oxide. At a temperature higher than about 1,700° to 1,800° C., a third reaction phase begins, during which the boiling caused by the reaction of the oxygen with the carbon in the bath no longer takes place only at the surface but also in the very heart of the pig iron bath. An emulsion is thus formed between the gaseous phase and the liquid metal, the level of which rises gradually and which surrounds the injection lance pipe. Within this emulsion, the oxygen is in direct contact with the liquid metal virtually without the intervention of slag. Under these conditions, extremely rapid direct decarburization of the metal is observed without the intermediate formation of chromium oxide. The gas-metal emulsion which has formed and whose level has risen above the initial surface of the metal bath acts as a filter which retains the solid particles of oxides of iron, chromium or other metal which might possibly be formed. Owing to the permanent contact between a fraction of the volume of the liquid metal, which can greatly exceed 25%, and the gaseous phase, the effectiveness of decarburization is increased significantly. For the same reason, the rise in temperature of the liquid metal is much quicker. All other things being equal, it is found to be possible to decarburize a Cr pig iron very rapidly and at a substantially constant speed by this process. Finally, the gas-metal emulsion acts as insulation for the main body of the bath and very significantly reduced the thermal losses.

Experience has shown that it is possible to maintain the gas-metal emulsion in a stable fashion during this third reaction phase, decarburization taking place very rapidly and at a substantially constant speed to a final carbon content of about 0.2%. At this moment chemical analyses have shown that the yield of the chromium which is present in solution in the metal bath reaches at least 97% by weight of the chromium contained in the pig iron initially introduced in the converter. This result is obtained without any addition of reducing elements or compounds such as silicon, ferrosilicon or others. It is possible to further reduce the carbon content of the metal bath by prolonging the blasting of oxygen, but, from this moment, re-oxidation of the chromium takes place since the diffusion of carbon limits the reaction kinetics. It is thus preferable, if the carbon content is to be further reduced, to subject the converter to a reduced pressure, for example by covering it with a sealed lid including a gas outlet pipe connected to vacuum pumps capable of reducing the pressure in the converter to levels of the order of about 10 Torr, or slightly less, with optional complementary introduction of oxygen and or neutral gas.

In many cases, the quantity of oxgen present in the pig iron and the residual slag is sufficient to oxidize the residual carbon, and a final carbon content of less than 0.03% is easily achieved. Under these conditions, the overall chromium yield is excellent and is of the order of about 98%. As stated earlier, this result is obtained without addition of any reducing elements or compounds.

EXAMPLE

The following non-limiting example is illustrative of a process in accordance with the invention.

A pig iron having the following approximate composition by weight: Cr 17%, C 6%, Si 0.3%, Mn 0.3%, S $<0.03\%$, P $<0.03\%$, balance Fe, is prepared.

60 kg of this pig iron is brought to about 1,430° C. in a furnace having an induction heater, the surface of the liquid pig iron being covered with approximately about 0.5 kg of lime. The oxygen is then blasted, i.e., injected, using a vertical lance pipe at a flow rate of 168 Nl/mn at a pressure of 9 relative bars. The diameter at the neck of the nozzle is 2 mm and the vertical distance between the end of the lance pipe and the surface of the metal bath 30 mm. The oxygen injected in this way reacts with the bath and three successive reaction phases, as discussed above, are observed.

In a first phase, the oxygen reacts mainly at the surface of the pig iron bath, preferably oxidizing the Cr, Si and Fe. As the oxides formed, containing mainly $Cr_2O_3$, accumulate at the surface of the bath, a secondary reaction for the reduction of these oxides by the carbon begins. The rate of this reduction reaction increases gradually as the temperature rises to about 1,650° C. at about the tenth minute after initiation of oxygen blasting. The CO formed is liberated during this period and burns off.

In a second phase, from the eleventh minute, the reduction of the oxides, mainly of chromium oxide, by the carbon becomes more rapid than the formation of these oxides. In this period of vigorous reaction, the temperature continues to rise, but less rapidly. From about the fifteenth minute, the decarburization rate stabilizes. The carbon content, which is now about 4%, will continue to decrease at a rate of about 0.3% per minute and, at the same time, a corresponding reduction in the chromium oxide will be observed. This mechanism continues until the twentieth minute. The bath temperature is now 1,750° C., while the C content has dropped to about 2.9%. At the end of this second phase, the metal oxides initially formed are almost completely reduced.

Towards the twentieth minute, the conditions are combined to initiate a third phase which permits the carbon content to be reduced to below about 0.3% and virtually to about 0.2%. At the beginning of this third phase, the temperature of the pig iron bath is very high. Under these conditions, and without a change in the conditions of oxygen flow rate and distance between the end of the lance pipe and the pig iron bath, the formation from the actual pig iron bath of an emulsion between gas and pig iron is observed, which rapidly covers the surface of the bath then increases in thickness until the initial volume of pig iron is doubled. Everything takes place as if the pig iron itself, under the action of the oxygen jet and the formation of CO, due to the direct reaction between the oxygen and the carbon contained in this pig iron, would boil in its entirety owing to the physico-chemical conditions produced. The reaction rates are high within the emulsion thus produced and this permits decarburization to continue at a rapid rate to a final carbon content of approximately 0.2%, which is achieved at the twenth-ninth minute. The temperature is now approximately 1,860° C. and oxygen blasting is stopped. At this stage chemical analyses have shown that the yield of the chromium is in the order of about 97.5% by weight.

Final decarburization is then carried out in a known manner by placing the furnace under a vacuum using pumps which permit a residual pressure of about 2 Torr to be attained in about twenty minutes. During this operation, the carbon content is reduced to about 0.02% merely due to the oxygen present in the liquid pig iron and the residual slag. At the end of this test, a chromium yield of about 98% is observed.

Owing to the small quantity of pig iron used in this Example, it is necessary to compensate for excessive thermal losses. For this purpose, additional induction heating is carried out at a substantially constant rate of consumption of power throughout the entire process so as to compensate optimally for the thermal losses. It will be understood that additional heating of this type is necessitated only by the reduced scale of the test. It will be appreciated that this heating would be superfluous on an industrial scale.

With further regard to the conditions for promoting the formation of the emulsion between the gaseous phase and the liquid chromium pig iron, it has been observed that it is significant, for initiating the formation of the gas-metal emulsion, for the initial temperature of the metal bath to satisfy the inequality $T_D+65C_D \geqq 1740$.

In this relationship:

$T_D$=initial temperature of the chromium pig iron in degrees Centigrade at the moment when oxygen blasting begins.

$C_D$=initial carbon content of the pig iron in weight %.

It is seen that, if the carbon content of the chromium pig iron is 6%, the temperature thereof should be higher than 1740° C.−390° C.=1350° C. at the moment when oxygen blasting begins. Experience has shown that, the higher the real temperature relative to the critical value thus determined, the sooner the conditions favorable for the establishment of an emulsion between the gaseous phase and the liquid metal will appear during the decarburization process. This means that the duration of the first two phases of the decarburization process, during which the carbon is eliminated mainly by reduction of the metal oxides formed, will be all the shorter, to the benefit of the third phase of direct decarburization of the liquid pig iron owing to the formation of a gas-metal emulsion.

It should be noted that the process can be applied not only to pig iron containing Cr without other significant additions, but also to pig iron containing Cr with additions of other metals such as Ni, Co, Mn or Mo. It is thus possible to obtain ferritic, semi-ferritic, austenitic or austenoferritic stainless steels directly by this process from a Cr-containing or NiCr-containing cast iron with suitable additions.

Experience has shown that one of the important factors for ensuring a long enough useful life of the oxygen injection tuyere inside the converter is the automatic lining formed on the surface of this tuyere during the carrying forth of the process. This tuyere is preferably made of copper which is cooled by internal circulation of water and its surface becomes progressively coated in operation by a layer of highly refractory oxides. This oxide layer has a double function as insulation and protection for the tuyere against the risks of perforation and thus of leakage of water.

I claim:

1. A process for the decarburization of a molten bath of chromium-containing pig iron initially containing by weight from about 1.5% to about 7% of C, from about 10% to about 30% of Cr, from about 0% to about 30% of Ni, from about 0% to about 20% of Co+Mn+Mo, and less than about 4% of Si, trace impurities, and balance Fe, said process comprising the steps of: (1) contacting the surface of the molten pig iron bath with an oxygen stream at supersonic speed from an oxygen jet whereby the force of the jet impact on the surface of the bath by turbulence effected by the oxygen stream, expells a slag coating covering the surface of the molten pig iron, (2) oxidizing in a first reaction phase the most oxidizable elements contained within the pig iron and more specifically Cr, Si, and Fe, while simultaneously increasing with a corresponding rise in temperature, the reduction of the metallic oxides of Cr, Si, and Fe thus formed by the reaction of said oxides with carbon; (3) in a second reaction phase, continuing the supersonic oxygen jet thereby maintaining the turbulence at the surface of the molten pig iron resulting in a further temperature rise and increased reduction rate of metallic oxides by carbon which reduction predominates the reaction; and (4) wherein a final reaction phase of decarburization commences when the carbon content in the pig iron attains the relationship $C_D/n$, wherein $C_D$ is the initial carbon content in weight percent and n is a number from about 1.5 to about 2.5, and said final reaction phase of decarburization is further characterized by the formation of a gas and pig iron emulsion resulting from the direct action of the oxygen on the molten pig iron, which emulsion is formed essentially free of a slag coating thereon and said gas comprising a mixture of oxides of carbon and oxygen.

2. A process according to claim 1, wherein decarburization by the direct action of the oxygen on the molten pig iron is continued to a carbon content of less than about 0.3%.

3. A process according to claim 1 wherein a chromium yield of at least about 97% by weight is achieved without adding a reducing agent.

4. A process according to claim 2 wherein a chromium yield of at least about 97% by weight is achieved without adding a reducing agent.

5. A process according to claims 1, 2 or 3, characterized by the formation of a gas and pig iron emulsion, wherein the gas phase of the gas and pig iron emulsion comprise a mixture of oxides of carbon and oxygen, where the carbon content of the molten metal and the temperature thereof satisfies the inequality $T_D+C_D \geqq 1740$, wherein $T_D$ is the initial temperature in degrees centigrade of the molten bath at the moment when the surface of the molten pig iron bath is contacted by the oxygen stream and $C_D$ is the initial carbon content in weight percent of the molten bath.

* * * * *

UNITED STATES PATENT AND TRADEMARK OFFICE

CERTIFICATE OF CORRECTION

PATENT NO. : 4,324,584

DATED : April 13, 1982

INVENTOR(S) : Georges Marizy

It is certified that error appears in the above-identified patent and that said Letters Patent are hereby corrected as shown below:

Column 8, line 13, the formula should appear as follows:

-- $T_D + 65C_D \geqq 1740$ --

Signed and Sealed this

Twenty-sixth Day of April 1983

[SEAL]

Attest:

GERALD J. MOSSINGHOFF

Attesting Officer

Commissioner of Patents and Trademarks